US005357766A

United States Patent [19]

Shiraishi et al.

[11] Patent Number: 5,357,766

[45] Date of Patent: Oct. 25, 1994

[54] AIR CONDITIONER

[75] Inventors: Akira Shiraishi, Chiyoda; Hiroshi Yatogo; Toshio Takashima, both of Ohizumi; Kazuo Mori, Ohta, all of Japan

[73] Assignee: Sanyo Electric Co., Ltd., Osaka, Japan

[21] Appl. No.: 49,074

[22] Filed: Apr. 20, 1993

[30] Foreign Application Priority Data

Apr. 27, 1992 [JP] Japan ..... 4-107709

[51] Int. Cl.[5] ..... F25B 41/00

[52] U.S. Cl. ..... 62/197; 62/324.6; 62/498

[58] Field of Search ..... 62/197, 511, 528, 324.6, 62/498

[56] References Cited

U.S. PATENT DOCUMENTS 4,263,787 4/1981 Domingorena ..... 62/528 X
4,576,011 3/1986 Glamm et al. ..... 62/324.6 X
4,688,390 8/1987 Sawyer ..... 62/324.6 X

FOREIGN PATENT DOCUMENTS 288902 11/1988 Fed. Rep. of Germany .

OTHER PUBLICATIONS

Patent Abstracts of Japan, vol. 013, No. 477, (M-885), Oct. 27, 1989.
JP-A-01 189 462 (Matsushita Electric), Jul. 28, 1989.

*Primary Examiner*—Henry A. Bennet
*Attorney, Agent, or Firm*—Darby & Darby

[57] ABSTRACT

Disclosed is an air conditioner of the present invention comprises a refrigeration cycle using a refrigerant compressor, a four-way valve, an external heat exchanger, an expansion device, and an internal heat exchanger in such a manner that these components are separately mounted in an external unit and an internal unit, wherein the external heat exchanger is mounted on the external unit; the internal heat exchange is mounted in the internal unit; both of the heat exchangers mounted in the units are connected to each other by means of a refrigerant piping to form the refrigeration cycle; and a control means is provided for changing the expansion amount of the expansion device according to the length of the refrigerant piping thereby adjusting the high-low pressure difference in the refrigeration cycle. With this construction, it is possible to carry out the optimal operation even for the longer refrigerant piping without making the size of each unit larger and enhancing the ability of each component of the refrigeration cycle.

11 Claims, 4 Drawing Sheets

AIR CONDITIONER

BACKGROUND OF THE INVENTION

The present invention relates to an air conditioner of a split type wherein an external unit having an external heat exchanger and an internal unit having an internal heat exchanger are disposed separately from each other, and respective heat exchangers are connected to each other by a refrigerant piping, to thus constitute a refrigeration cycle.

As the air conditioner of a split type wherein an external heat exchanger is connected to an internal heat exchanger by a refrigerant piping, for example, Japanese Patent Publication No. sho 57-31057 discloses an air conditioner of a split type which includes an external heat exchanger disposed outdoors, such as in a garden, and an internal heat exchanger disposed in the interior.

In such an air conditioner of a split type, since the internal heat exchanger and the external heat exchanger are disposed separately from each other, the length of the refrigerant piping for connecting the external heat exchanger to the internal heat exchanger becomes different depending upon the locations where these heat exchangers are disposed.

Also, since the diameter of the refrigerant piping is generally limited at a specified value, in the case that refrigerant is made to flow in the refrigerant piping, there is generated a specified passage resistance in the refrigerant piping. The resistance tends to increase in proportional to the length of the refrigerant piping.

Accordingly, when the resistance in the refrigerant piping is large, namely, the length of the refrigerant piping is long, the refrigerant circulating amount is sometimes reduced to be less than the designed value of the refrigeration cycle. This presents a problem that the refrigeration ability as designed cannot be obtained.

It may be considered to use a compressor having a large capacity in the refrigeration cycle and a receiver tank having a large capacity for achieving the high capacity. This makes it possible to cope with the situation when the refrigerant piping is long. The above attempt, however, is disadvantageous in that, for short refrigerant piping, the high capacity compressor and a large sized receiver tank are wasteful, and further, the internal unit and the external unit are made larger, thereby obstructing the miniaturization of these units.

SUMMARY OF THE INVENTION

Accordingly, an object of the present invention is to provide an air conditioner capable of carrying out the optimal operation even for the longer refrigerant piping without making the size of each unit larger and enhancing the ability of each component in the refrigeration cycle.

An air conditioner of the present invention comprises a refrigeration cycle using a refrigerant compressor, a four-way valve, an external heat exchanger, an expansion device, and an internal heat exchanger in such a manner that these components are separately mounted in an external unit and an internal unit, wherein the external heat exchanger is mounted on the external unit; the internal heat exchanger is mounted in the internal unit; both of the heat exchangers mounted in the units are connected to each other by means of a refrigerant piping to form the refrigeration cycle; and a control means is provided for changing the expansion amount of the expansion device according to the length of the refrigerant piping thereby adjusting the high-low pressure difference in the refrigeration cycle.

The above expansion device is intended to reduce the expansion amount of the refrigerant by the control means in the case that the refrigerant piping is long.

Also, the above expansion device comprises a main expansion element for permitting a refrigerant to flow in a refrigeration cycle for cooling operation or a refrigeration cycle for heating operation; an auxiliary expansion element connected in series to the main expansion element for permitting a refrigerant to flow only in a refrigeration cycle for heating operation; a refrigerant bypass passage for bypassing either of the main expansion element and the auxiliary expansion element; and an opening/closing valve provided on the bypass passage, wherein the opening/closing valve is opened in reducing the expansion amount of the expansion device by the controller.

The above bypass passage further comprises an auxiliary expansion element.

Also, an air conditioner of the present invention comprises a refrigeration cycle using a refrigerant compressor, a four-way valve, an external heat exchanger, an expansion device, and an internal heat exchanger in such a manner that these components are separately mounted in an external unit and an internal unit, thereby constituting a refrigeration cycle for cooling operation of changing the four-way valve for evaporating a refrigerant by the internal heat exchanger and a refrigeration cycle for heating operation of changing the four-way valve for condensing the refrigerant by the external heat exchanger, wherein the external heat exchanger is mounted on the external unit; the internal heat exchange is mounted in the internal unit; both of the heat exchangers mounted in the units are connected to each other by means of a refrigerant piping to form the refrigeration cycle; and a control means is provided for changing the expansion amount of the expansion device according to the length of the refrigerant piping and the state of the cooling operation or the heating operation thereby adjusting the high-low pressure in the refrigeration cycle.

The above expansion device is intended to reduce the expansion amount of a refrigerant in the case that the refrigerant piping is longer.

Also, the above expansion device is intended to reduce the expansion amount of the refrigerant by the controller in the case that the refrigerant piping is longer and a refrigeration cycle for heating operation is constituted.

Further, the above expansion device comprises a main expansion element for permitting a refrigerant to flow in a refrigeration cycle for cooling operation or a refrigeration cycle for heating operation; an auxiliary expansion element connected in series to the main expansion element for permitting a refrigerant to flow in a refrigeration cycle for heating operation; a refrigerant bypass passage for bypassing either of the main expansion element and the auxiliary expansion element; and an opening/closing valve provided on the bypass passage, wherein the opening/closing valve is opened in reducing the expansion amount of the expansion device by the controller.

The above bypass passage further comprises an auxiliary expansion element.

Namely, according to the air conditioner of the present invention thus constructed, in the case that the refrigerant piping for connecting the external heat exchanger to the internal heat exchanger is long so that the resistance due to the refrigerant piping is enlarged, it is possible to usually keep the difference between the high pressure and low pressure of the refrigerant in the refrigeration cycle within the specified range by adjustment of the expansion amount (resistance) of the expansion device. Accordingly, it is possible to usually keep the refrigeration cycle in the optimal condition irrespective of the length of the refrigerant piping.

DETAILED DESCRIPTION OF THE PREFERRED EMBODIMENT

Figure 1:
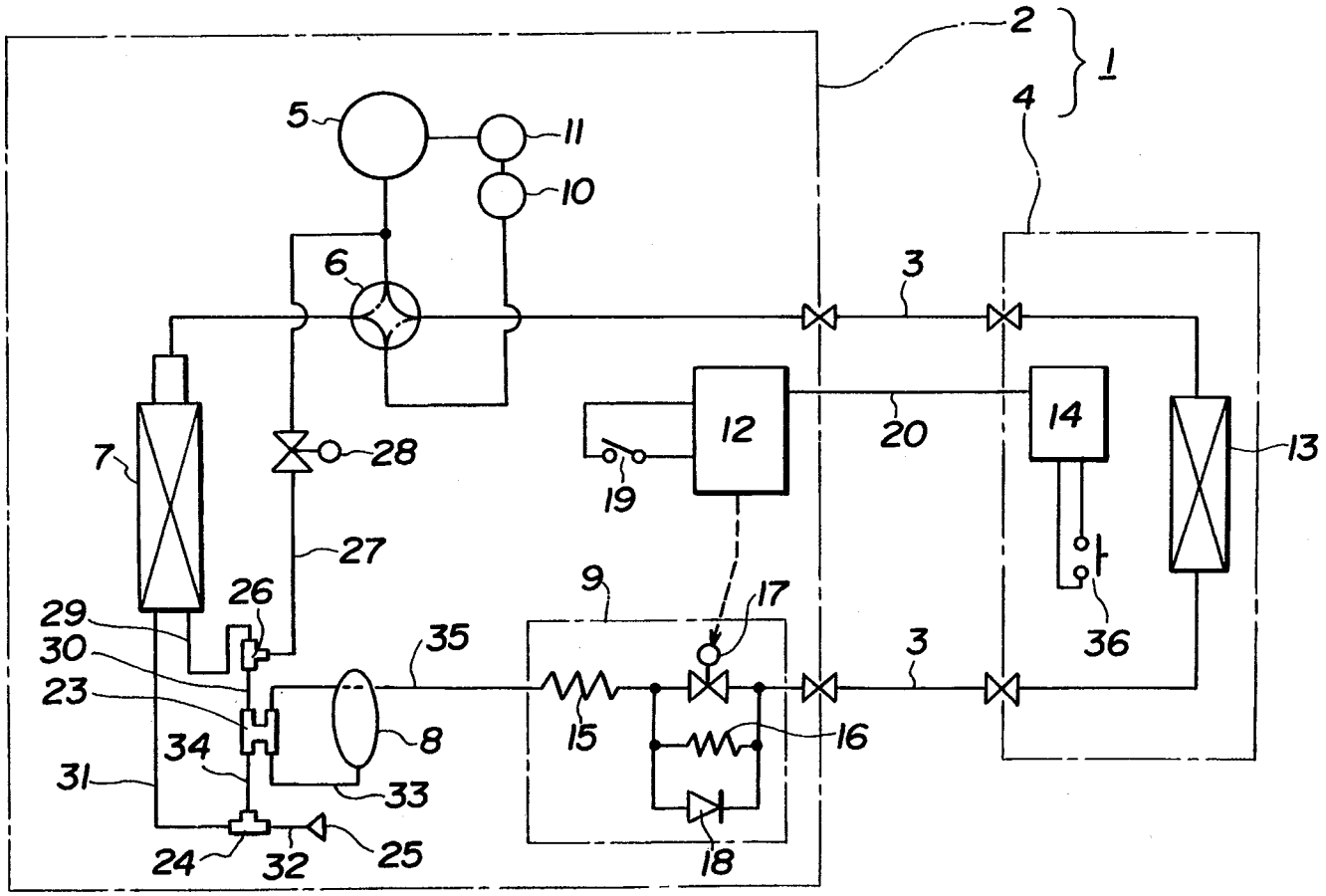
FIG. 1 is a refrigerant circuit diagram of an air conditioner showing a first embodiment of the present invention.

Hereinafter, the preferred embodiments will be described with reference to the drawings. Referring to FIG. 1, reference numeral 1 indicates an air conditioner, which includes an external unit 2 and an internal unit 4 connected to the external unit 2 by a refrigerant piping 3.

The external unit 2 mainly includes a compressor 5, four-way valve 6 for switching operations between heating and cooling, an external heat exchanger 7, a receiver tank 8, an expansion device 9, two accumulators 10 and 11, and a controller 12 for controlling an opening/closing valve 17 constituting the above expansion device 9.

The internal unit 4 mainly includes an internal heat exchanger 13 and a controller 14 for controlling a cooling operation and heating operation. These components are connected to each other by a refrigerant piping, to thus constitute a refrigeration cycle. When the four-way valve 6 is in the state as shown by the solid line of FIG. 1, the compressed refrigerant discharged from the compressor 5 is circulated through the internal heat exchanger 13, expansion device 9, receiver tank 8, and external heat exchanger 7. In the above, the internal heat exchanger 13 functions as a condenser and the external heat exchanger 7 functions as an evaporator. Thus, the heating operation is made by the internal heat exchanger 13.

Also, when the four-way valve 6 is in the state as shown by the dotted line of FIG. 1, the compressed refrigerant discharged from the compressor 5 is circulated through the external heat exchanger 7, receiver tank 8, expansion device 9 and internal heat exchanger 13. In the above, the internal heat exchanger 13 functions as the evaporator and the external heat exchanger 7 functions as the condenser. Thus, the cooling operation is made by the internal heat exchanger 13.

In addition, during this refrigeration cycle (refrigerant circuit), the external unit 2 and the internal unit 4 are disposed separately from each other, and which are filled with the refrigerant in such an amount as to correspond to the case that the refrigerant piping 4 for connecting these units 2 and 4 to each other has a length of 25 m. When the length of the refrigerant piping 3 is short, the excessive refrigerant is stored in the receiver tank 8, and accordingly, the refrigerant in a suitable amount can be usually circulated during the refrigeration cycle.

Here, an external fan and an internal fan for supplying air to the external heat exchanger 7 and the internal heat exchanger 13 are not shown.

The expansion device 9 is constituted of a main expansion element (capillary tube) 15, an auxiliary expansion element (capillary tube) 16 connected in series to the main expansion element 15, an opening/closing valve 17 provided with a bypass passage through which the refrigerant bypasses the auxiliary expansion element 16, and a check valve 18 for permitting the refrigerant to flow only in one direction (from the external heat exchanger 7 to the internal heat exchanger 13).

In the heating operation, the refrigerant discharged from the compressor 5 is condensed at the internal heat exchanger 13, being expanded by the expansion device 9, and then evaporated at the external heat exchanger 7. At this time, the refrigerant passes through the expansion device 9 in order of the auxiliary expansion element 16 and main expansion element 15 (the opening/closing valve 17 is in the closed state). Accordingly, the high pressure refrigerant is expanded by an amount set by the main expansion element 15 and the auxiliary expansion element 16.

In the cooling operation, the refrigerant discharged from the compressor 5 is condensed at the external heat exchanger 7, expanded at the expansion device 9, and evaporated at the internal heat exchanger 13, thus performing the cooling. At this time, in the expansion device 9, the refrigerant passes the check valve 18 for bypassing the auxiliary expansion element 16, and thus passes only the main expansion element 15 (the opening/closing valve 17 is in the closed state). Accordingly, the high pressure refrigerant is expanded by an amount set only by the main expansion element 15.

Next, in the heating operation at the time when the open/closing valve 17 is in the opening state according to a signal from the controller 12, the refrigerant discharged from the compressor 5 is condensed at the internal heat exchanger 13 to release the heat, being expanded in the expansion device 9, and is evaporated at the external heat exchanger 7. At this time, in the expansion device 9, the refrigerant passes through the opening/closing valve 17 and the main expansion element 15 in this order. Accordingly, the high pressure refrigerant is expanded in an amount set only by tile main expansion element 15.

Reference numeral 19 indicates a set-up switch, which is set in the case that, in the disposition of the external unit 2 and the internal unit 4, the length of the refrigerant piping 3 for connecting the external unit 2 to the internal unit 4 is more than a specified dimension (for example, in the range of from 15 to 25 m). In the case that the length of the refrigerant piping 3 is within the specified value (for example, less than 15 m), the set-up switch is not set. In the installation works for the external unit 3, for example, in connection of the refrigerant piping 3 or the wiring 20, the set-up switch 19 is switched according to the installation dimension of the refrigerant piping 3.

When the heating operation is carried out in the case that the set-up switch 19 is set, the controller 12 outputs a signal for opening the opening/closing valve 17.

Figure 2:
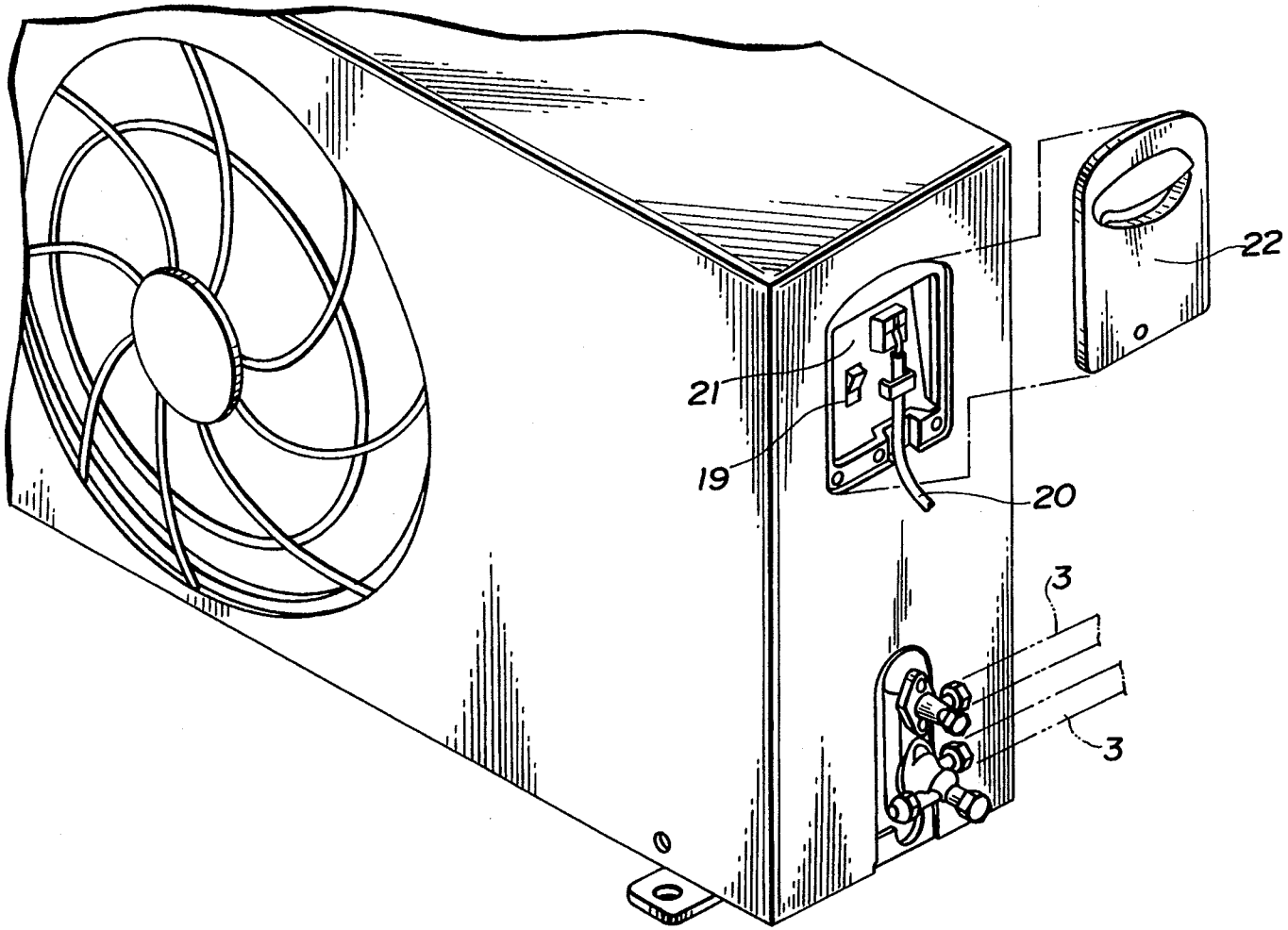
FIG. 2 is a perspective view showing a main part of an external unit of the air conditioner according to the first embodiment of the present invention.

In addition, as shown in FIG. 2, the set-up switch 19 is provided on a terminal board 21 connected to the wiring 20 of the external unit 2, and is intended not to be operated when a terminal cover 22 is mounted.

Also, in FIG. 1, reference numeral 23 indicates a flow dividing tube for connecting the external heat exchanger 7, expansion device 9 and receiver tank 8 to each other; 24 is a flow dividing tube for connection of a service valve 25; 26 is a flow dividing tube for connection of a hot gas bypass tube 27. Further, reference numeral 28 indicates an opening/closing valve provided on the hot gas bypass tube 27, which is opened according to a signal from the controller 12 in a defrost operation, to introduce part of the high temperature refrigerant from the compressor 5 to the external heat exchanger (evaporator) 7 through the refrigerant piping 29 (connecting the external heat exchanger 7 to the flow dividing tube 27), thus performing the defrost of the external heat exchanger 7.

Reference numeral 30 indicates a refrigerant piping for connecting the flow dividing tube 26 to the flow dividing tube 23, which is intended to introduce part of the high temperature refrigerant supplied through the opening/closing valve 28 to the flow dividing tube 23. Reference numeral 31 indicates a refrigerant piping for connecting the external heat exchanger 7 to the flow dividing tube 24; 32 is a refrigerant piping for connecting the flow dividing tube 24 to the service valve 25; 33 is a refrigerant piping for connecting the flow dividing tube 23 to the receiver tank 8; 34 is a refrigerant piping for connecting the flow dividing tube 23 to the flow dividing tube 24; and 35 is a refrigerant piping for connecting the flow dividing tube 23 to the expansion device 9.

Reference numeral 36 is a set-up switch provided on the internal unit 4, by means of which the cooling operation and the heating operation are set.

Figure 3:
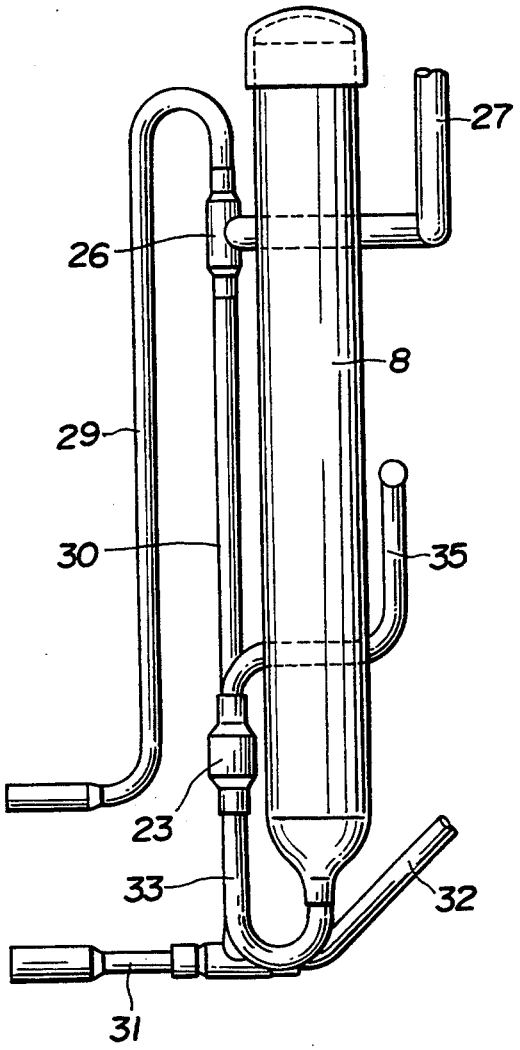
FIG. 3 is a perspective view showing a main part of a receiver tank of the air conditioner according to the first embodiment of the present invention.
Figure 4:
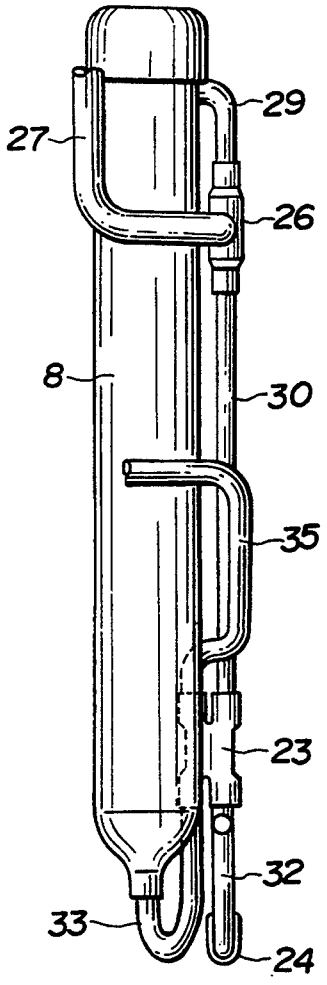
FIG. 4 is a side view showing a main part of the receiver tank of the air conditioner according to the first embodiment of the present invention.

In addition, the actual disposition and the shape of the piping in the receiver tank 8 and the vicinity thereof are shown in FIGS. 3 or 4.

In the air conditioner 1 having the above construction, the internal unit 4 and the external unit 2 are disposed separately from each other, and accordingly, the refrigerant piping 3 needs to be made longer or is sufficient to be shorter according to the installed location.

First, there will be described the standard piping wherein the refrigerant has a length less than 15 m. In this case, the set-up switch 19 of the external unit 2 is at the "standard piping" in the installation works (in the state that the switch 19 is not set). Accordingly, the controller 12 always closes the opening/closing valve 17 in both the cooling operation or the heating operation. In the cooling operation, since the refrigerant from the external heat exchanger 7 passes the main expansion element 15 and the check valve 18, it is expanded only by the main expansion element 15.

Also, in the heating operation, since the refrigerant from the internal heat exchanger 13 passes the auxiliary expansion element 16 and the main expansion element 15, it is expanded by the auxiliary expansion element 16 and the main expansion element 15.

In this standard piping, since the refrigerant is filled to correspond to the case of the longer piping situation, it is somewhat excessive; however, the excessive refrigerant is stayed in the receiver tank 8 and the accumulators 10 and 11, which makes it possible to prevent the refrigerant from being stored in the heat exchangers 7 and 13 to the utmost.

The excessive refrigerant is stored mainly in the receiver tank 8 in the cooling operation, whereas it is stored in the two accumulators 10 and 11 in the heating operation. As shown in FIGS. 3 and 4, the receiver tank 8 is connected to the refrigerant circuit between the external heat exchanger 7 and the expansion device 9 by one refrigerant piping 33, so that in the cooling operation the excessive liquid refrigerant is gradually stored in the tank 8 from the lower portion by the pressure of the refrigerant circuit.

In the conventional structure including two refrigerant pipings of inlet tube and the outlet tube on the way of the refrigerant circuit, there occurs the noise through the echo of the sound of the flushed refrigerant; however, according to the structure of this embodiment, it is possible to prevent the flush of the refrigerant in the tank 8 and hence to suppress the flush sound to the maximum. Also, since the lower portion of the tank 8 is connected to the refrigerant circuit by the refrigerant piping 33, the return of the refrigerant in the refrigerant circuit is made rapid.

Next, there will be described the case of the the longer piping wherein the refrigerant piping has a length in the range of from 15 to 25 m. In this case, in the installation, the set-up switch 19 of the internal unit 2 is set at the "longer piping" (in the state that the switch 19 is set).

In the case that the set-up switch 19 is set at the "longer piping", the controller 12 opens the opening/closing valve 17 when the heating operation is started. In the cooling operation, the refrigerant from the external heat exchanger 7 passes through the main expansion element 15 and the check valve 18, and accordingly, it is expanded only by the main expansion element 15. On the other hand, in the heating operation, the controller 12 opens the opening/closing valve 17, the refrigerant from the internal heat exchanger 13 passes through the opening/closing valve 17 and the main expansion element 15, and it is expanded only by the main expansion element 15.

Accordingly, when the refrigerant piping has a long size and the refrigeration cycle is set at the cycle for heating operation, the expansion amount is reduced under the consideration of the expansion resistance due to the refrigerant piping 3, so that even in the longer refrigerant piping 3, the total of the expansion amount due to the refrigerant piping 3 and the expansion amount due to the expansion device 9 is almost equal to the expansion amount due to the expansion device 9 in the case of the shorter refrigerant piping 3. Accordingly, it is possible to keep the high-low pressure difference in the refrigeration cycle to be an approximately equal value (within a specified allowance range) irrespective of the length of the refrigerant piping 3.

As a consequence, it is possible to solve the disadvantages that the flow of the refrigerant becomes worse for the longer refrigerant piping 3 and the refrigerant is stored in the internal heat exchanger 3, and that the temperature of the discharged refrigerant of the compressor is excessively increased and thereby the safety apparatus (not shown) is operated.

Also, in the air conditioner 1, since the switch 19 for setting the longer piping and the standard piping is disposed in the external unit 2, it is possible to set the the set-up switch 19 along with the connection of the works of of the external unit 2 and the wiring 20.

Also, after connection of the works at the external unit 2 in which the installation dimension of the refrigerant piping 3 is determined, the set-up switch 19 is set, so that it is possible to prevent a mistake in setting the set-up switch 19. Further, the set-up switch 19 is disposed in the external unit 2, and accordingly, when being set once, it is not re-set if the length of the refrigerant piping is not changed. Also, since the set-up switch 19 includes the terminal safety cover 22, it is possible to eliminate the fear that the operator touches and operates it carelessly.

Figure 5:
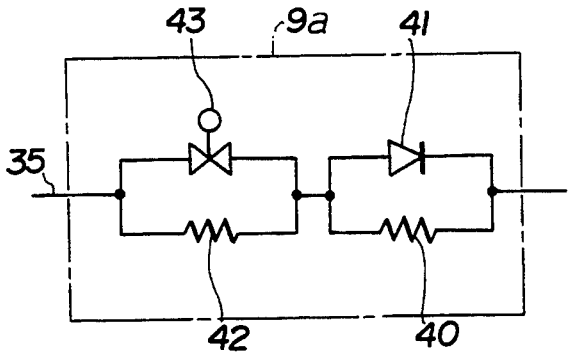
FIG. 5 is a refrigerant circuit diagram showing a main part of a second embodiment of the present invention.

FIG. 5 is a refrigerant circuit diagram showing a main part of an expansion device 9*a* showing a second embodiment of the present invention. In this case, the expansion device 9*a* includes an auxiliary expansion element 40 through which the refrigerant flows in the heating operation, a check valve 41 connected in parallel to the element, a main expansion element 42 connected in series to the auxiliary expansion element 40, and an opening/closing valve 43 connected in parallel to the element.

In the case of the longer piping (in the state that the set-up switch is set), the opeing/closing valve 43 is opened in the heating operation by the controller (not shown). In the case of the standard piping wherein the refrigerant piping 3 has a standard length, the refrigerant passes though the auxiliary expansion element 40 and the main expansion element 42 to be expanded in the heating operation. In the case of the longer piping wherein the refrigerant piping 3 has a longer length, the refrigerant passes only through the auxiliary expansion element 40 to be expanded in the heating operation. Accordingly, when the refrigerant piping 3 is longer, the expansion amount at the expansion device 9*a* is made smaller, to thus adjust the high-low pressure difference in the refrigeration cycle.

Figure 6:
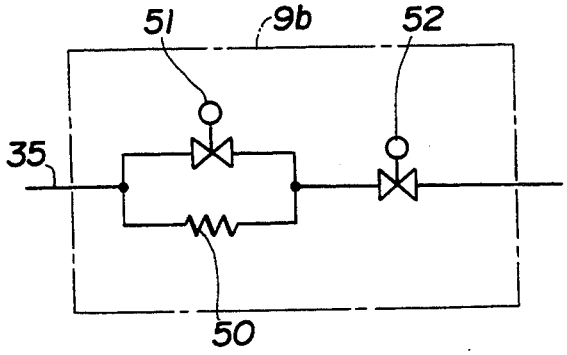
FIG. 6 is a refrigerant circuit diagram showing a main part of a third embodiment of the present invention.

Also, FIG. 6 is a refrigerant circuit diagram showing a main part of an expansion device 9*b* of a third embodiment of the present invention. In this figure, the expansion device 9*b* includes a main expansion element 50 through which the refrigerant flows in the heating operation, an opening/closing valve 51 connected in parallel to the element, an electric expansion valve which is connected in parallel to the element 50 and is controlled such that the opening is made smaller in the heating operation than that in the cooling operation.

In the case of the longer piping (in the state that the set-up switch 19 is set), the opening/closing valve 51 is opened in the heating operation by a controller (not shown). In the case of the standard piping wherein the refrigerant piping 3 has a standard length, the refrigerant passes through the electric expansion valve 52 and the main expansion element 50 to be expanded in the heating operation. In the case of the standard piping wherein the refrigerant piping has a standard length, the refrigerant passes only through the electric expansion valve 52 to be expanded at the heating operation. Accordingly, when the refrigerant piping 3 is longer, the expansion amount at the expansion device 9*b* is made smaller, to thus adjust the high-low pressure difference in the refrigeration cycle.

Figure 7:
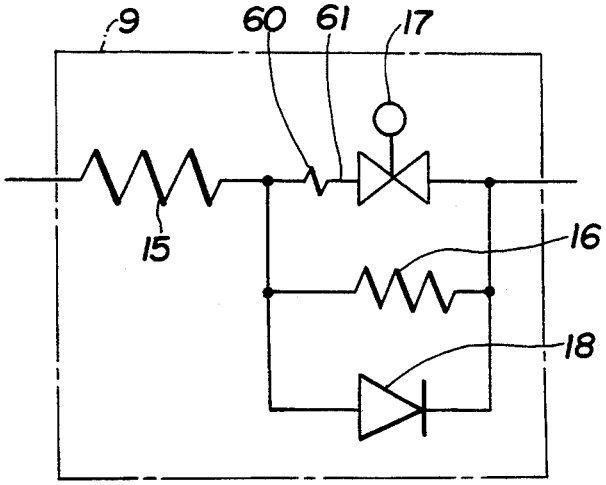
FIG. 7 is a refrigerant circuit diagram showing a main part of a fourth embodiment of the present invention.

Further, FIG. 7 is a refrigerant circuit diagram showing a main part of an expansion device 9*c* of a fourth embodiment of the present invention. In the above expansion devices 9, 9*a* and 9*b*, in particular, when the heating operation is started with the opening/closing valve 17 being opened, there exists little a pressure difference across both ends of the opening/closing valve 17; however, since the valve body in the check valve 18 is vibrated due to the pressure difference generated by the pulsation of the compressor 5 to generate the noise (there occurs the so-called chattering phenomenon), the expansion device 9*c* in this embodiment includes an auxiliary expansion element 60 disposed in series to the opening/closing valve 17.

The auxiliary expansion element 60 is constituted of a tube having an inside diameter of 4.5 mm smaller than a bypass tube 61 having an inside diameter of 3 mm. This auxiliary expansion element 60 is intended to make the pressure difference between the upstream side and the down stream side at about 0.01 to O.05 kg/cm$^2$, and which has a lowest resistance as compared with the expansion elements 15 and 16.

Figure 8:
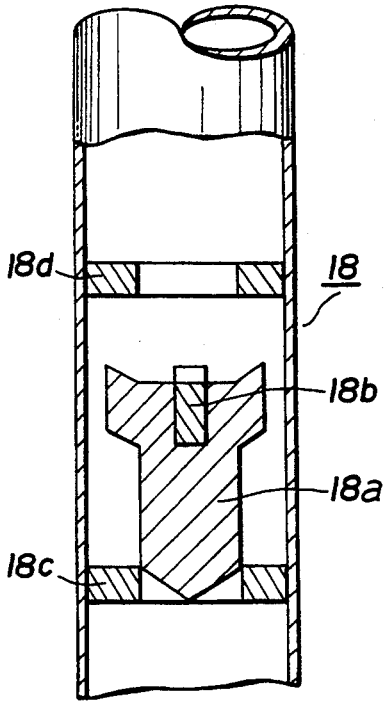
FIG. 8 is a refrigerant circuit diagram showing a main part of a check valve of the air conditioner of the present invention.

FIG. 8 is a sectional view of the check valve 18, wherein reference numeral 18*a* is a valve body made of nylon, and is provided with a weight 18*b* made of metal. The valve body 18*a* is set at a specific gravity of from 1.15 to 1.20 g/cm$^2$ slightly heavier than that (1.1 g//cm$^2$) of the refrigerant liquid. Accordingly, as shown in FIG. 8 even in the state that the check valve 18 is disposed in the longitudinal direction, and the refrigerant liquid reaches to the check valve 18 from the up and down directions, the valve body 18 is prevented from being floated in the refrigerant liquid. Reference numeral 18*c* indicates a valve seat, and 18*d* indicates a stopper.

Accordingly, when the opening/closing valve 17 is opened, the pressure difference across the opening/closing valve 17 is kept to be 0.01 to 0.05 Kg/cm$^2$ by means of the auxiliary expansion element 60. Thus, since the pressure is applied in the direction of closing the check valve 18, the check valve 18 is free of the chattering phenomenon.

Also, in starting the compressor 5, while the pressure difference across the opening/closing valve 17 provided with the auxiliary expansion element 60 is small yet, the valve body 18*a* of the check valve 18 is heavier than the reFrigerant liquid to be prevented from being floated, thereby preventing the chattering phenomenon to the utmost.

In addition, by provision of the auxiliary expansion element 60, the chattering phenomenon of the check valve is thus prevented. This chattering phenomenon is generated until the refrigerant pressure of each refrigerant piping becomes somewhat stable. Accordingly, there may be adopted the following manner; namely, in the case of the longer piping, upon the starting of the heating operation, without the auxiliary expansion element 60 in this embodiment, by means of the controller 12 for controlling the opening/closing valve 12, the opening/closing valve 17 is opened so as to retard the opening by a specified time, for example, 3.5 min. (required for somewhat stabilizing the refrigerant pressure of each refrigerant piping) since the starting of the operation of the compressor 5, thus preventing the chattering phenomenon.

Also, there may be used a capillary tube and a conduit in which the midway portion is crushed as the auxiliary expansion element 60.

As described above, according to the air conditioner of the present invention, since the controller 12 opens the opening/closing valve 17 in the heating operation, the refrigerant is allowed to flow in the opening/closing valve 17 to reduce the expansion resistance of the refrigerant. Consequently, in the case that the refrigerant piping is longer than the specified dimension and the expansion resistance is larger, it is possible to allow the refrigerant to smoothly flow in the refrigerant circuit, and to perform the control according to the condition in such a case. Namely, in the case that the refrigerant piping 3 for connecting the external heat exchanger 7 to the internal heat exchanger 13 is made longer, and the resistance due to the refrigerant piping 3 is large, it is possible to keep the high-low pressure difference of the refrigerant in the refrigeration cycle within a specified range by adjustment of the expansion amount of the expansion device 9.

Accordingly, it is possible to usually keep the refrigeration cycle at the suitable state irrespective of the length of the refrigerant piping.

What is claimed is:

1. An air conditioner comprising:

a refrigeration compressor, an external heat exchanger, an expansion device including first and second expansion means, and an internal heat exchanger to effect a refrigeration cycle, and a valve to direct the flow of refrigerant for heating and cooling operations, means for separately mounting said external and internal heat exchangers in respective external and internal units which are to be at spaced locations, means for connecting said compressor, valve, external and internal heat exchangers and expansion device to perform a refrigerant cycle, including refrigerant piping of some length for connecting said separated external and internal heat exchangers, said first expansion means of said expansion device maintaining a high-low pressure of the refrigeration cycle at a desired state when the length of said refrigerant piping is below a predetermined length and said second expansion means maintaining the high-low pressure at the desired state when said refrigerant piping is longer than said predetermined length, and control means for selectively activating one or both of said first and second expansion means according to the length of the said refrigerant piping and the state of the heating or cooling operation of the air conditioner for changing the volume of expansion produced by said expansion device to adjust the high-low pressure of the refrigeration cycle.

2. An air conditioner according to claim 1, wherein said expansion device reduces the expansion amount of the refrigerant when said refrigerant piping is longer than said predetermined length.

3. An air conditioner according to claim 1, wherein said expansion device first expansion means comprises a main expansion element for permitting a refrigerant to flow in a refrigeration cycle for cooling operation or a refrigeration cycle for heating operation and said expansion device second expansion means comprises an auxiliary expansion element connected in series to said main expansion element for permitting a refrigerant to flow only in a refrigeration cycle for heating operation; a passage for bypassing a selected one of said main expansion element and said auxiliary element; and an opening/closing valve provided in said bypass passage, wherein during heating operation said first expansion means comprises said main expansion element and said second expansion means comprises said auxiliary expansion element and said control means opens or closes said opening/closing valve to change the operating state of said first expansion means or said second expansion means.

4. An air conditioner according to claim 3 wherein said bypass passage further bypasses said auxiliary expansion element.

5. An air conditioner according to claim 1 wherein said expansion device reduces the expansion amount of a refrigerant when said refrigerant piping is longer than said predetermined length.

6. An air conditioner according to claim 1, wherein said expansion device reduces the expansion amount of the refrigerant when said refrigerant piping is longer than said predetermined length and a heating operation is performed.

7. An air conditioner according to claim 6, wherein said first expansion means of said expansion device comprises a main expansion element for permitting a refrigerant to flow in a refrigeration cycle for a cooling operation or a refrigeration cycle for a heating operation; and said second expansion means comprises an auxiliary expansion element connected in series to said main expansion element for permitting a refrigerant to flow in a refrigeration cycle for a heating operation; a refrigerant bypass passage for bypassing a selected one of said main expansion element and said auxiliary expansion element; and an opening/closing valve provided in said bypass passage, wherein during a heating operation said first expansion means comprises said main expansion element and second expansion means comprises said auxiliary expansion element and said control means opens or closes said opening/closing valve to change the operating state of the main or auxiliary element associated with said bypass passage.

8. An air conditioner according to claim 7, wherein said bypass passage further comprises an auxiliary expansion element.

9. An air conditioner as in claim 1 wherein said valve during heating operation supplies refrigerant for condensing to said internal heat exchanger and during cooling operation supplies refrigerant for condensing to said external heat exchanger.

10. An air conditioner according to claim 1 wherein said first and second expansion means are connected in series, and means operated by said control means for bypassing a selected one of said first and second expansion means.

11. An air conditioner according to claim 9 further comprising switch means for enabling or disabling said control means.

* * * * *